United States Patent [19]

Nissen

[11] 4,045,021

[45] Aug. 30, 1977

[54] TRAMPOLINE APPARATUS FOR USE IN CONNECTION WITH TUMBLING AND THE LIKE

[75] Inventor: George P. Nissen, Cedar Rapids, Iowa

[73] Assignee: Nissen Corporation, Cedar Rapids, Iowa

[21] Appl. No.: 596,311

[22] Filed: July 16, 1975

Related U.S. Application Data

[63] Continuation of Ser. No. 449,243, March 8, 1974, abandoned.

[51] Int. Cl.[2] ..... A63B 5/18

[52] U.S. Cl. ..... 272/65

[58] Field of Search ..... 272/65, 70; 5/111, 337; 297/30, 423; 182/139

[56] References Cited

U.S. PATENT DOCUMENTS

| | | | |
|---|---|---|---|
| 470,819 | 3/1892 | Davis | 5/337 |
| 952,871 | 3/1910 | Browder | 272/65 |
| 1,379,064 | 5/1921 | Welch | 5/111 |
| 2,918,963 | 12/1959 | MacNeil | 297/30 |
| 3,201,126 | 8/1965 | Nissen | 182/139 X |

FOREIGN PATENT DOCUMENTS

| | | | |
|---|---|---|---|
| 1,248,909 | 10/1971 | United Kingdom | 272/65 |

*Primary Examiner*—Richard C. Pinkham
*Assistant Examiner*—William R. Browne
*Attorney, Agent, or Firm*—Haven E. Simmons; James C. Nemmers

[57] ABSTRACT

A form of trampoline apparatus for use in connection with tumbling and the like employs a relatively long-narrow bed resiliently suspended between a pair of side rails only so that the two opposite ends of the bed are unobstructed by any cross rails or other structure. The two rails are supported above the floor by a substructure which interconnects them and holds the rails apart against the tension of the bed. One end of the bed inclines upwardly toward the remainder of the bed which is horizontal with respect to the floor. The trampoline is narrower relative to its length and having dimensions such that the length is substantially three times or more its width to provide directional rebound characteristics.

9 Claims, 5 Drawing Figures

FIG 3
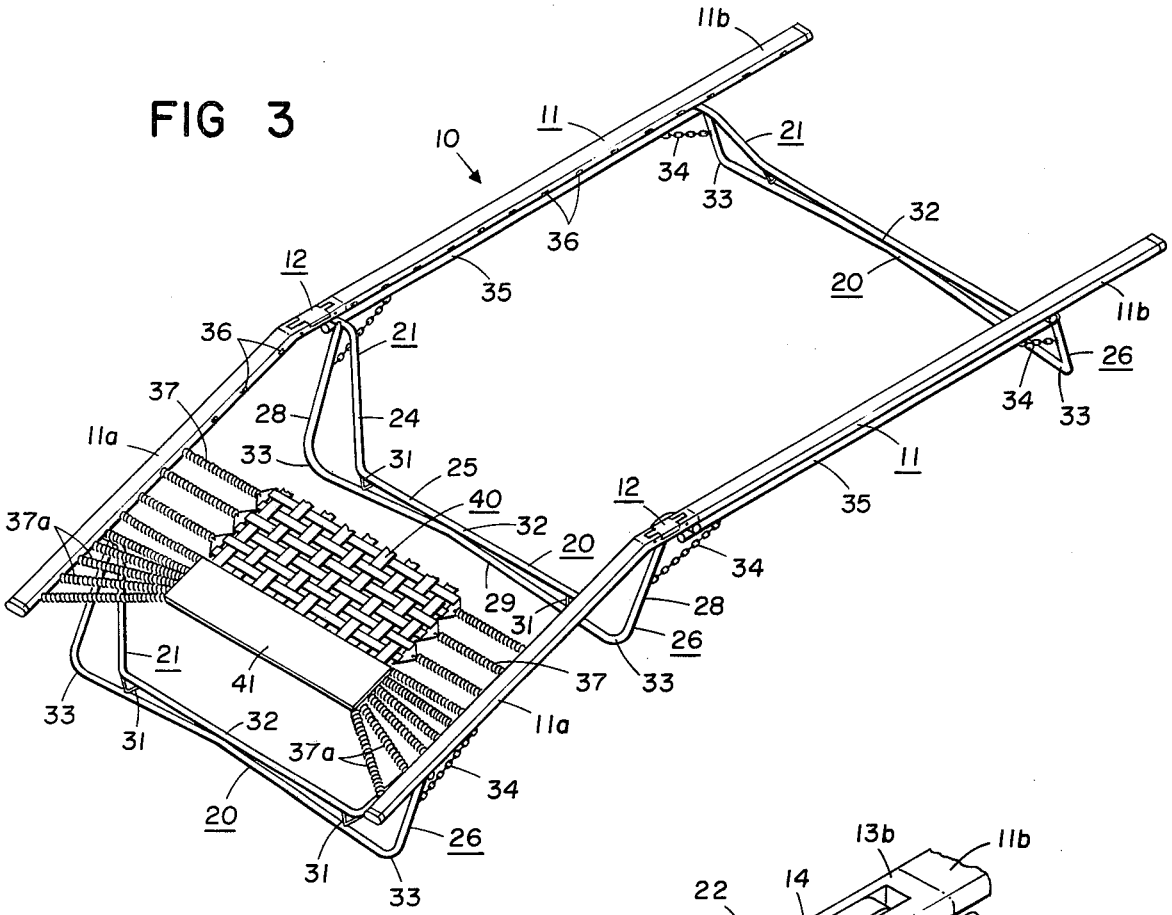
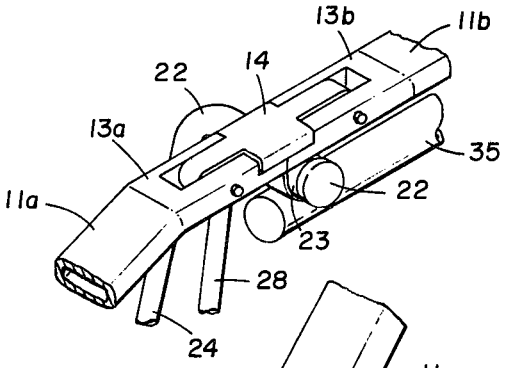
FIG 4
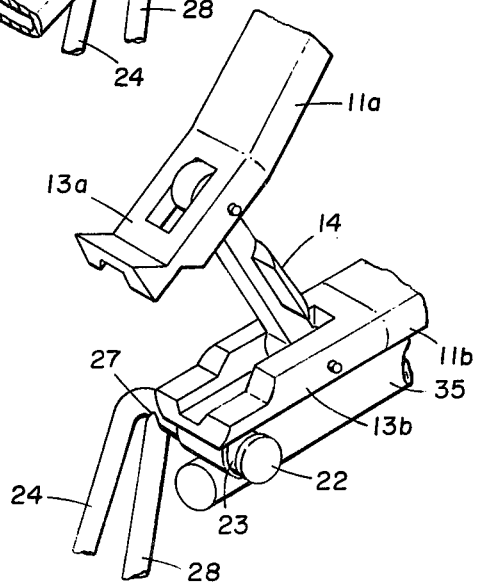
FIG 5

TRAMPOLINE APPARATUS FOR USE IN CONNECTION WITH TUMBLING AND THE LIKE

CROSS REFERENCE TO RELATED APPLICATION

This is a continuation of application Ser. No. 449,243, filed Mar. 8, 1974, now abandoned.

BACKGROUND OF THE INVENTION

Small trampoline-like devices have for many years been used in connection with the teaching of tumbling and as a device for mounting various pieces of gymnastic equipment. They have also been used by springboard divers at swimming pools, and by cheerleaders and stuntmen to achieve greatly augmented leaps. Typical of these devices is that sold under the trademark MINI-TRAMP by Nissen Corporation of Cedar Rapids, Io. Essentially, these consist of a relatively small circular or square frame within which is suspended a resilient bed, the frame being supported not far above the floor by a pair of U-shaped leg members which can be adjusted so that the plane of the bed is parallel or inclined to the floor. Several years ago it was discovered that a wide variety of tumbling exercises and the like could be performed by rebounding from one such device to another and then executing a dismount maneuver onto a landing pad. For this purpose, two of the square frame devices were used and separated by a spacer block level with the two beds. The performer ran onto the first bed, which was typically inclined upwardly toward the spacer block then rebounded over the latter onto and off of the second bed which was positioned parallel to the floor. In fact, a substantial and internationally recognized sport has grown up utilizing that basic combination.

But certain hazards and deficiencies are involved in that apparatus as so constructed and arranged. In the first place, the portions of the bed frames lying across, as opposed to those along each side, of the path of the performer present danger of injury should the performer inadvertently strike one during his act, either when landing on the first bed or thereafter upon the second bed. In the second place, the relatively small, square beds suspended along all four sides to their frames tend to make it somewhat critical that the performer land on them in the middle or else the nature and direction of his rebound will be substantially affected. Furthermore, it is often difficult to keep the two devices and the intervening spacer block together; the three tend to separate in use, with obvious risk to the performers, and must be constantly watched and regularly restored to position. The spacer block itself is also somewhat of a hazard or impediment since it has substantially no rebound character as do the two beds. Hence, the primary object of the present invention is the provision of improved apparatus for use in conjunction with the foregoing sport.

SUMMARY OF THE INVENTION

Essentially, the present invention is a single piece of apparatus which better accomplishes the purposes and function of the three separate pieces heretofore used and at the same time eliminates their hazards. A single, relatively elongated but narrow trampoline bed is resiliently suspended between a pair of side rails. Each rail comprises two pieces pivoted with respect to each other so that one end of the bed can be folded up onto the other. The rails and bed are supported above the floor by three transverse, U-shaped leg assemblies which also serve to hold the rails apart against the tension of the bed. One leg assembly supports the aforesaid end of the bed so that it inclines upwardly toward the remainder of the bed, the latter being supported in turn by the other two leg assemblies so that it is horizontal with respect to the floor. Each leg assembly can fold up against the rails so that when the bed is also folded up, the entire apparatus is readily portable.

Since the two side rails are not connected by cross rails or another structural member which could be inadvertently struck by a performer, the chief hazard of the prior apparatus is removed. Likewise, since only a single bed is involved, the apparatus can no longer separate in use and the dangers of an intervening spacer block are eliminated. The rails and the springs or other resilient members which connect the edges of the bed to the rails are covered by strips of protective padding which also reduce the chances of injury. The bed itself is an open weave of strips of nylon webbing, as is typical in the case of regular trampoline beds, and is demarcated by overlying panels of opaque material into a mounting bed at the inclined end, a dismount bed at the other end and a foul area therebetween. The performer simply runs onto the mounting bed, rebounds over the foul area onto the dismount bed and then onto a landing pad below the end of the latter bed, performing whatever tumbling maneuver is desired during his passage from the dismount bed to the landing pad. The lack of any suspension of the ends of the bed from cross rails is compensated in large part by the relative narrow width of the bed compared to its length and by a splayed cluster of springs along the side edges of the bed adjacent each corner which also provide very uniform rebound characteristics no matter where along the bed the performer strikes, all as hereafter explained in more detail. Other and further features and advantages of the present invention will be apparent from the drawings and the more detailed description which follows.

BRIEF DESCRIPTION OF THE DRAWINGS

FIG. 3 is an isometric view of the frame of the apparatus of FIG. 2 illustrating its structure.

FIGS. 4 and 5 are detailed isometric views of the hinge structure between the mounting and dismount beds of FIGS. 2 and 3.

DETAILED DESCRIPTION OF THE PREFERRED EMBODIMENT

Figure 1:
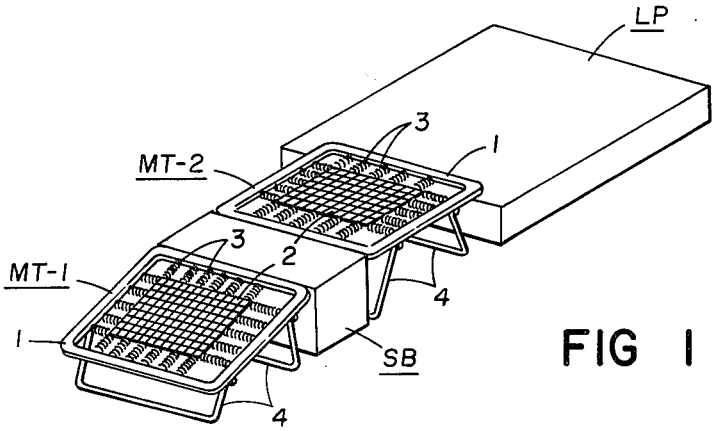
FIG. 1 is an isometric view of the previous apparatus employing two small trampolines of the type described separated by a spacer block and leading onto a landing pad below the end of one.

In FIG. 1 a pair of small trampoline-like devices MT-1 and MT-2 are shown in position separated by a spacer block SB, each device having a square frame 1 within which is resiliently suspended a woven bed 2 by springs 3. Adjustable U-shaped legs 4 support the device MT-1 in an upwardly inclined position against the edge of the top face of the spacer block SB while the opposite edge of the latter adjoins the other device MT-2 whose legs 4 support it parallel to the floor. A landing pad LP is placed below the far end of the device MT-2. As noted, this arrangement is old and a performer runs onto MT-1, rebounds over the block SB onto MT-2 and thence off the latter onto the pad LP, executing whatever maneuver is called for between his rebound from MT-2 and his landing on the pad LP.

Figure 2:
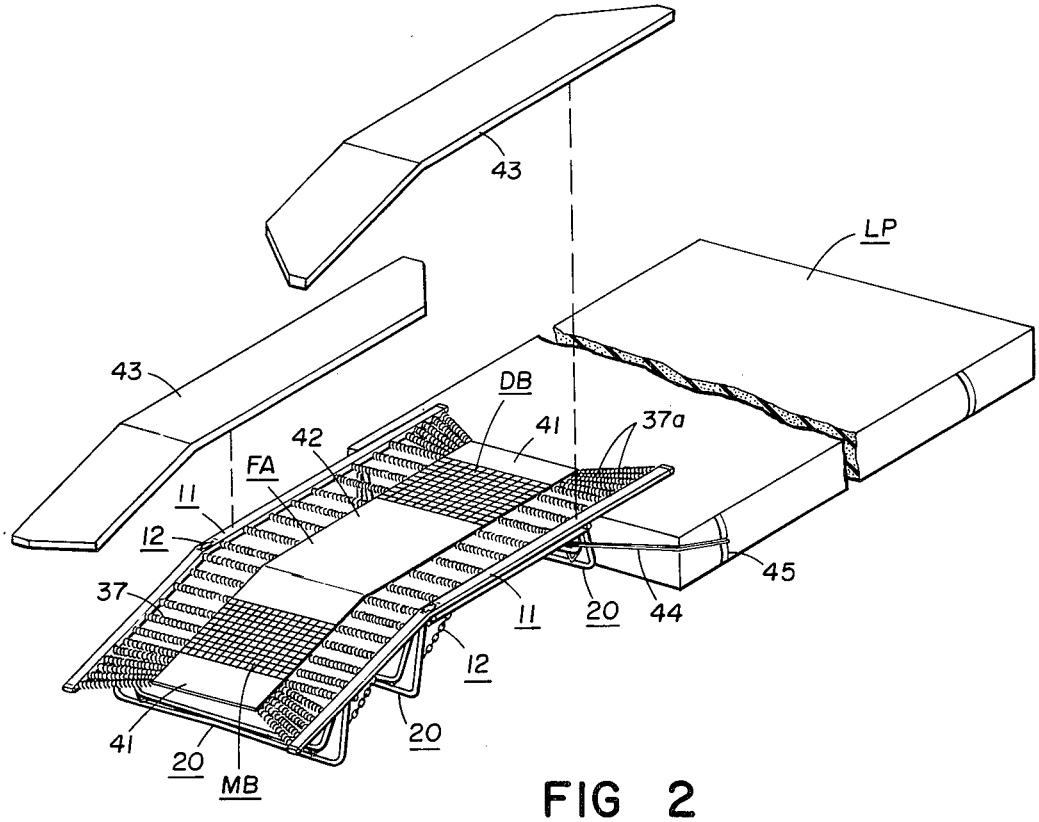
FIG. 2 is an isometric view of the apparatus of the present invention positioned for use with a landing pad.

Turning to FIGS. 2 and 3, the apparatus of the present invention instead employs a single, open-ended frame 10 having elongated side rails 11 only formed of flattened oval tubing. Each rail 11 comprises two sections 11*a* and 11*b* joined by a double-jointed hinge assembly 12 incorporating hinge knuckles 13*a* and 13*b* (see FIGS. 4 and 5) welded to the adjacent ends of the rail sections 11*a* and 11*b*. The knuckles 13*a* and 13*b* are joined by a lock bar 14 which allows the rail sections 11*a* to be swung up from the position shown in FIG. 4 about common transverse axes and folded back down upon the sections 11*b* as shown in FIG. 5. The hinges 12, as will be observed, lock up to prevent any folding of the rail sections 11*a* in the opposite direction, and are essentially of the nature shown and described in U.S. Pat. No. 2,969,124 which may be referred to for further details. Beyond the hinges 12 the rail sections 11*a* angle downwardly toward the floor, while the rail sections 11*b* are disposed substantially parallel to the floor, both being supported in these positions by three U-shaped leg assemblies 20 extending down from and transversely between the rails 11. Two of the leg assemblies 20 support the respective rail sections 11*a* and 11*b* at locations well inboard of their outer ends while the third supports the inner ends of the sections 11*b* at the hinges 12. As shown most clearly in the case of the latter, each leg assembly 20 consists of an inner tube 21 whose ends 22 are cranked and journaled in bushings 23 welded beneath and across the hinge knuckles 13*b*. The tube 21 then extends convergingly downwardly at 24 from each bushing 23 and then parallel to and above the floor at 25 transversely between the rails 11. The ends of an outer tube 26 are butt welded at 27 to the tube ends 22 inboard of the hinge knuckles 13b from which the tube 26 extends directly down at 28 to and transversely across the floor at 29 spacedly beneath the tube 21 and in the plane of the latter. The transverse tube sections 25 and 29 are welded to each other through spacers 31 at the ends of the tube section 25 and the tube section 29 is upwardly bowed and welded at 32 to the section 25 to provide opposite feet 33 which engage the floor. The three leg assemblies 20 are splayed apart in the manner shown in FIG. 3 and are retained in these positions by lengths of chain 34 interconnecting the respective tube sections 28 and a pair of tubular rails 35 welded beneath the bushings 23. If desired or necessary, the feet 33 may be covered with boots or leggings (not shown) which frictionally engage the floor to help keep the apparatus in place when in use. Hence the frame 10 can be readily folded up by swinging the rail sections 11*a* over onto the sections 11*b* and the leg assemblies 20 in turn against the rails 11.

To the inboard edges of the rails 11 are welded rows of eyelets 36 to which the ends of extensible coil bed springs 37 are hooked, their other ends being hooked in turn to the side edges of a relatively narrow, rectangular bed 40, in a manner hereafter described. The bed 40 is of construction customary in trampolines, being an open weave of relatively narrow strips of flexible webbed nylon material, and terminates some distance inboard of the ends of the rails 11. Note that the leg assemblies 20 are in effect truss-like structures which not only support the rails 11 and bed 40 but also hold the former apart against the tension and resiliency of the bed springs 37. The bed ends themselves are covered by vinyl panels 41 and the bed area to each side of the axes of the hinges 12 is covered by a larger vinyl panel 42 in order to define a foul area FA between a mounting bed MB on the inclined portion of the bed 40 and a dismount bed DB adjacent the end of the horizontal portion of the bed 40 (see FIG. 2). In order better to support the ends of the bed 40, along the side edges of the panels 41 the springs 37*a* are attached in well known fashion to the ends of each of the transverse strips of the bed 40 and splayed outwardly toward the adjacent ends of the rails 11, as best shown in FIG. 3. Between these two locations the density of the springs 37 is reduced, each being attached to the ends of a pair of transverse strips, of the bed 40 instead, also in well known fashion. Indeed, along the side edges of the bed 40 between the panels 41 even the initial tension of the springs 37 can with advantage be reduced (as by spring extenders for instance) so that in effect the springs 37*a* at the ends of the bed 40 are stronger than those along the remainder. This provides the bed 40 with a character quite like that of a regular trampoline bed. For added safety, a pair of protective pads 43 covers the rails 11 and springs 37. Insofar as actual dimensions are concerned, for example the frame 10 may have an overall width of 5 feet, a length of 11 feet and a height of 22 inches above the floor for the dismount bed DB. The bed 40 itself may be approximately 28 inches wide and 9½ feet in length, the inclined portion making an angle of about 30° with respect to the floor and being about two-thirds the length of the horizontal portion. The springs 37 are about 9 inches in length unextended.

A performer, of course, runs onto the mounting bed MB, must rebound over the foul area FA and onto the dismount bed DB from which he executes whatever maneuver is required before alighting on the landing pad LP placed below and well under the end of the dismount bed DB, being retained in position by elastic cords 44 interconnecting the adjacent leg chains 34 and handles 45 along the edges of the pad LP. The lack of cross rails between the rails 11 eliminates the hazards found in the apparatus shown in FIG. 1 and the leg assemblies 20 are also well out of the performer's path. The fact that the performer does not have to jump over cross rails and their attendant springs at each end of the bed 40 also allows his mount and dismount to be made much more smoothly and naturally, something like jumping onto and off of a diving board, for instance. The great length of the bed 40 compared to its width provides in effect a long tumbling mat surface or channel down which the performer proceeds, the preferable ratio of bed length to bed width being about 3 to 1 or more. If the bed 40 is appreciably wider than this relative to its length, its ends will be looser and less able to accommodate the absence of support from cross rails between the ends of the rails 11. That is to say, the narrower the bed 40 relative to its length the less effective and thus the less necessary is any support across its ends, the springs 37 along its sides thereby assuming the added roll of maintaining the bed 40 relatively taut with respect to its long axis as well as taut between the side rails 11. The nature and direction of the rebound from a single long-narrow bed 40 is also much more uniform for these reasons. Were two separate beds used end to end between the rails 11, the length-width ratio would suffer, and even with all eight corners of the two supported with angled springs 37*a* the beds would tend to be too loose with respect to the long axis of the frame 10. They would also begin to suffer from some of the same deficiencies of the two separate beds 2 in the case of the prior arrangement shown in FIG. 1, particularly the lack of uniform rebound characteristics depending upon where along them the performer strikes. In short, the apparatus described constitutes major and significant improvements over that previously used for the sport involved and has won immediate and wide acceptance.

Though the present invention has been described in terms of a particular embodiment, being the best mode known of carrying out the invention, it is not limited to that embodiment alone. Instead, the following claims are to be read as encompassing all adaptations and modification of the invention failing within its spirit and scope.

I claim:

1. Trampoline apparatus for use in connection with tumbling and the like, the apparatus including elongated laterally spaced side members extending longitudinally of the apparatus and defining a trampoline-like bed frame but open at its opposite ends, a trampoline-like bed but narrower relative to its length of flexible material extending longitudinally of the apparatus disposed between the frame side members, the length of the bed being substantially 3 times or more its width to provide directional rebound characteristics, the bed having a pair of bed side edges along and spaced from the frame side members and first and second opposite bed ends unenclosed by the respective opposite ends of the frame, a plurality of elongated and resiliently extendable members interconnecting the bed side edges and the frame side members to effectively resiliently suspend the bed in tension therebetween, the resilient members most adjacent the open ends of the bed providing a greater tension on the side edges of the bed than is provided by the resilient members along the remainder of the bed side edges effective so that a performer running along a floor or the like and then jumping onto the first end of the bed is rebounded therefrom onto and then off the second end of the bed and onto the floor or the like, and means for supporting the frame and bed in overlying spaced relation above a floor or the like.

2. The apparatus of claim 1 wherein the supporting means maintain the portion of the bed adjacent the first bed end thereof in a position inclined upwardly toward the remainder of the bed.

3. The apparatus of claim 2 wherein the supporting means maintain the remainder of the bed in a substantially horizontal position with respect to a floor or the like.

4. The apparatus of claim 3 wherein the respective ends of the side members terminate longitudinally beyond the end edges of the first and second bed ends, soem of the resilient members disposed at the lengths of the bed side edges adjacent their intersections with the bed end edges being angled from the bed side edges outwardly toward the ends of the side members.

5. The apparatus of claim 4 wherein the supporting means also maintain the side members in spaced relation against the tension and resiliency of the bed and are out of the path of a performer jumping onto the rebounding from the bed as aforesaid.

6. The apparatus of claim 5 wherein the supporting means include a plurality of supporting assemblies spaced at longitudinal intervals along the side members, each supporting assembly having portions depending from the side members and transverse portions interconnecting the lower ends of the depending portions.

7. The apparatus of claim 6 including means delineating a mounting area on the inclined bed portion, a dismount area on the horizontal bed portion, and a foul area therebetween, the foul area including contiguous portions of the inclined and horizontal bed portions.

8. The apparatus of claim 7 wherein the side members along each side of the bed comprise a pair of rails articulated with respect to each other about a common transverse axis separating said inclined and horizontal bed portions, whereupon the two bed portions can be folded one upon the other.

9. The apparatus of claim 8 including protective padding overlying each side member and the resilient members connected thereto.

* * * * *